US007330131B2

(12) United States Patent
Zanotti et al.

(10) Patent No.: US 7,330,131 B2
(45) Date of Patent: Feb. 12, 2008

(54) AUTOMATIC SYSTEM FOR MONITORING AND MANAGING THE ADMITTANCE TO PARKING PLACES

(76) Inventors: Gianfranco Zanotti, Viale San Peretto, 10, San Pietro in Cariano (IT) 1-37029; Alessandro Zuccato, Via della Consortia, 2, Avesa (IT) 1-37127

( * ) Notice: Subject to any disclaimer, the term of this patent is extended or adjusted under 35 U.S.C. 154(b) by 144 days.

(21) Appl. No.: 10/539,711

(22) PCT Filed: Dec. 17, 2003

(86) PCT No.: PCT/IT03/00825

§ 371 (c)(1),
(2), (4) Date: Jun. 17, 2005

(87) PCT Pub. No.: WO2004/055751

PCT Pub. Date: Jul. 1, 2004

(65) Prior Publication Data

US 2006/0100921 A1 May 11, 2006

(30) Foreign Application Priority Data

Dec. 17, 2002 (IT) ..... VR2002A0129

(51) Int. Cl.
*G08G 1/14* (2006.01)

(52) U.S. Cl. ..... 340/932.2; 340/928; 705/13

(58) Field of Classification Search ..... 340/932.2, 340/928; 701/117; 705/13
See application file for complete search history.

(56) References Cited

U.S. PATENT DOCUMENTS

| | | | | |
|---|---|---|---|---|
| 5,153,586 | A * | 10/1992 | Fuller | 340/932.2 |
| 5,266,947 | A | 11/1993 | Fujiwara et al. | |
| 5,351,187 | A * | 9/1994 | Hassett | 705/13 |
| 5,910,782 | A | 6/1999 | Schmitt et al. | |
| 6,340,935 | B1 * | 1/2002 | Hall | 340/932.2 |
| RE37,822 | E * | 8/2002 | Anthonyson | 701/1 |
| 7,019,670 | B2 * | 3/2006 | Bahar | 340/932.2 |

FOREIGN PATENT DOCUMENTS

| | | |
|---|---|---|
| FR | 2 802 004 | 6/2001 |
| WO | WO 00/46068 | 8/2000 |
| WO | WO 01/20558 A1 | 3/2001 |
| WO | WO 01/63563 | 8/2001 |

OTHER PUBLICATIONS

International Search Report for International Application No. PCT/IT 03/00825 Dated Apr. 21, 2004, 2 page(s).

* cited by examiner

*Primary Examiner*—Brent A. Swarthout
(74) *Attorney, Agent, or Firm*—Greenberg Traurig LLP

(57) ABSTRACT

An integrated automatic system for remote monitoring and management of vehicle access and parking in urban areas on a selective bases comprises: a mobile recognition device (17), in which a user code is memorised, and which can be positioned inside a vehicle (18); a detection sensor (11) installed close to a respective parking space (19); a network connecting the detection sensors (11) to a fixed data collection station (20); a control centre (21), connected to the second network, for decoding and reprocessing the data.

13 Claims, 2 Drawing Sheets

AUTOMATIC SYSTEM FOR MONITORING AND MANAGING THE ADMITTANCE TO PARKING PLACES

This application is a national stage filing under 35 U.S.C. 371 of International Application PCT/IT2003/000825, filed on Dec. 17, 2003 which claims priority from Italian Application No: VRZ00ZA000129, filed on Dec. 17, 2002. The entire teachings of the referenced Applications are incorporated herein by reference. International Application PCT/IT2003/000825 was published under PCT Article 21(2) in English.

TECHNICAL FIELD

This invention concerns an integrated automatic system for remote monitoring and management of vehicle access and parking in urban areas on a selective basis.

More specifically, this invention refers to an integrated automatic system for the control and management of spaces designed for the parking of vehicles in general in urban areas.

According to another aspect, this invention refers to a procedure for the management of this integrated automatic system.

This invention can be applied in the industrial sector for the production of automatisms and transducers in general.

BACKGROUND ART

It is known that in countries with a high level of technology, the growing number of motor vehicles has made traffic problems extremely important, requiring local administrations to impose limits on the circulation and parking of vehicles in urban areas.

These problems are particularly evident in town centres and in areas with a high density of traffic, making it necessary to introduce structured systems to regulate access and to control parking, generally based on the allocation of limited traffic zones and/or on tariff and selective authorization mechanisms (long-term access and parking permits for residents, limited permits for registered users, "time" tariffs for occasional users, etc.).

Receiver-transmitter devices for the automatic detection of the presence or transit of vehicles have already been proposed and consolidated technologies already exist on the market, albeit presenting some problems.

The power of the signals must, in fact, be very low to prevent the system from being too complex, to limit the costs and to restrict electromagnetic pollution to negligible levels, taking into account the considerable presence of the devices in highly frequented areas.

A further problem is represented by the fact that the devices currently used do not guarantee a high degree of efficiency, presenting a considerable number of errors and cases of malfunctioning.

The detection and management means of these systems also require a considerable use of human resources, particularly for the material operations of monitoring the areas in which access or parking are managed selectively.

Another drawback is represented by the fact that the efficacy of the means used is encumbered by limits and interruptions that are difficult to avoid.

DESCRIPTION OF THE INVENTION

This invention proposes to provide an integrated automatic system for the remote monitoring and management of vehicle access and parking in urban areas on a selective basis, which is able to eliminate or significantly reduce the problems described above.

This invention also proposes to provide an automatic system which can guarantee the possibility of identifying stationary or slowly moving vehicles in specific monitoring points considered useful by the management for the functionality of the system.

A further aim of this invention is to provide a system based on the exchange of relatively low-power signals to restrict the electromagnetic power emitted.

This is achieved by means of a system with the features described in the main claim.

The dependent claims described advantageous embodiments of the invention.

According to another aspect this invention also proposes to provide a procedure for the management of this integrated automatic system.

This is achieved by means of a procedure with the features described in claim 7.

The integrated automatic system according to this invention comprises:

- a mobile recognition device, in which a user code is memorised, which can be positioned inside a vehicle;
- a detection sensor installed in a respective parking space;
- a network for the connection of these detection sensors to a fixed data collection station;
- a possible second network for the connection of several fixed stations for the collection of data on respective parking space areas;
- a control centre for decoding and reprocessing of the data.

According to the invention the identification code of the user is memorised in a device appropriately positioned in the respective vehicle authorized to use the system.

This code allows the management to automatically identify the data relative to the vehicle and the user, and makes it possible to activate a series of services, including the automatic payment of the parking fee against prepaid amounts or by means of authorization to charge the fee to a bank account.

The mobile recognition device is a miniaturized instrument which can be positioned inside a vehicle and is equipped with a memory containing the user identification code.

The code is transmitted automatically by radio-frequency to the detection sensors, located at the accesses or in the parking spaces in the protected areas.

According to one embodiment of the invention, the procedure for the management of this integrated automatic system foresees:

- the detection of the presence of a vehicle in a specific respective parking space;
- the recognition of the vehicle as authorized or not authorized to use the space;
- the emission of a visual and/or acoustic signal demonstrating the occupation of the space;
- the detection of the parking time of the vehicle in the space;
- the transmission of the occupation of the space and of the data relative to the recognised or not recognised vehicle to a general area controller device;
- the transmission of the data collected by the area controller device or by several area controller devices to a general central unit designed to store the data regarding recognised vehicles and to immediately report any unauthorised parking by vehicles without authorization;

the calculation, by the central unit, of the fee in relation to the parking time;

if required, transmission of the data relative to the fee charged to the bank authorized for payment with the consent of the user.

The integrated automatic system, for the remote monitoring and management of vehicle access and parking in urban areas on a selective basis, allows rationalised and advantageous management of the problems regarding access and parking in urban areas.

This system and this procedure also make it possible to achieve high levels of reliability for the user with reference to the security of the data contained in the memory of a miniaturized circuit.

The integrated automatic system ensures a significant reduction of the pollution emitted by vehicles in densely populated areas due to a drastic reduction in the time spent by the users in search of a parking space.

The transmission of data at low frequencies makes it possible to restrict the levels of electromagnetic pollution well below the threshold of caution.

DESCRIPTION OF THE DRAWINGS

Other features and advantages of the invention will become evident on reading the following description of one embodiment of the invention, given as a non-binding example, with the help of the enclosed drawings, in which.

DESCRIPTION OF AN EMBODIMENT

Figure 1:
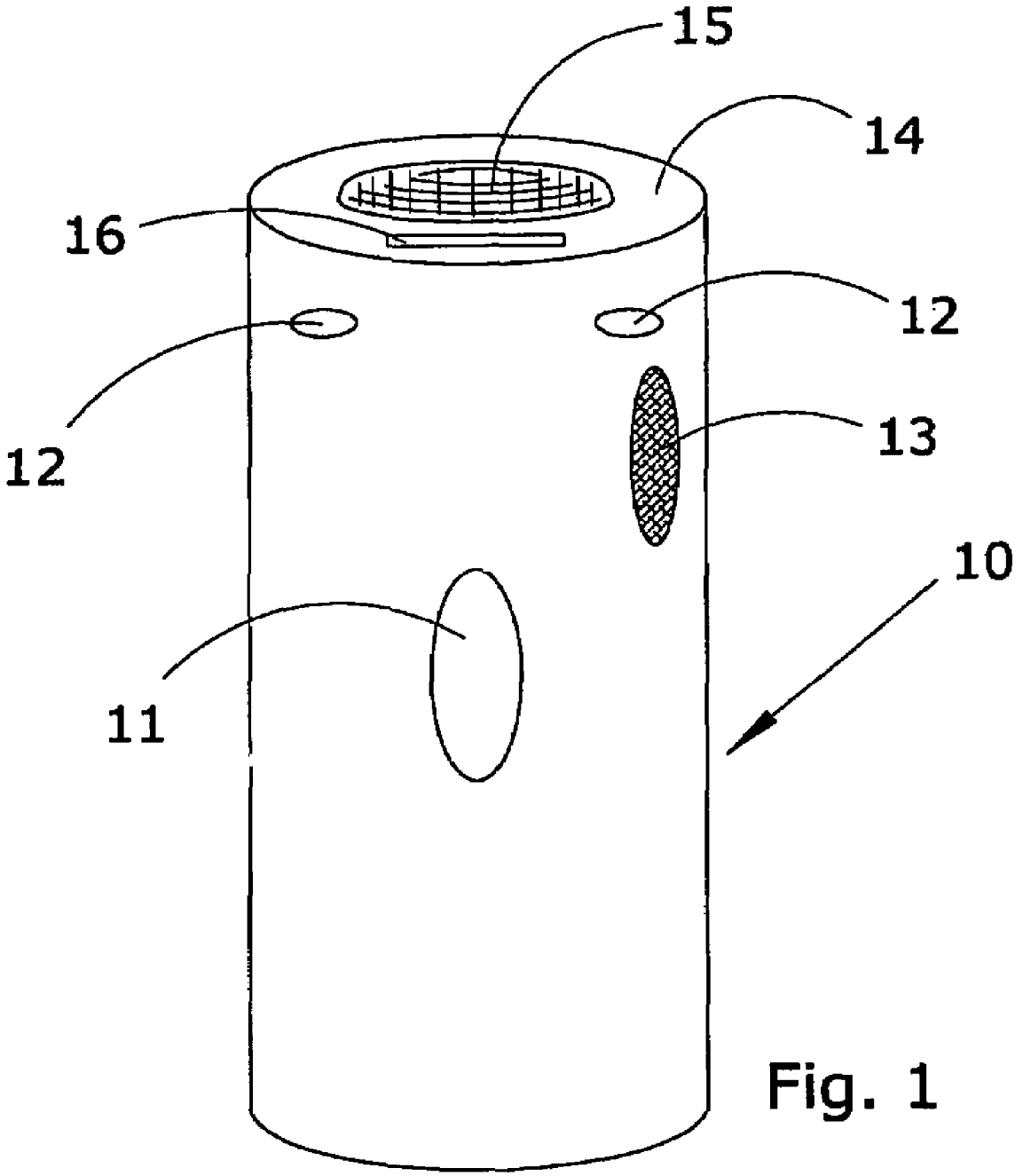
FIG. 1 represents a prospective view, slightly from above, of a column used to construct the system according to the invention.

In FIG. 1, the reference number 10 indicates in general a fixed column, in the case in question a column 10 designed to detect the presence of a vehicle in a parking space adjacent to it.

In the case illustrated, the column 10 has a cylindrical shape and is equipped with at least one presence sensor 11 designed to detect the parking of a vehicle.

According to other embodiments, the column 10 may have a different shape and be equipped with a number of presence sensors 11, or a multitasking sensor.

In the embodiment illustrated in the figures, the presence sensor 11 is positioned on the side of the column 10. It may, however, be placed in any position.

The side of the column 10 may also be equipped with luminous indicators 12 confirming the detection of an authorized or non-authorized vehicle.

The color of these indicators 12 may be green in the first case and red in the second in order to attract the attention of any supervision personnel present in the area or to indicate the possibility or impossibility of parking.

The upper part of the column 10 may present a buzzer 13 which can be activated if an unauthorised vehicle is parked.

According to this embodiment, the top 14 of the column 10 is equipped with an interface 15, for communication with the user, and a slot 16 designed to issue receipts or printed messages of use to authorized users.

DESCRIPTION OF THE SYSTEM

Figure 2:
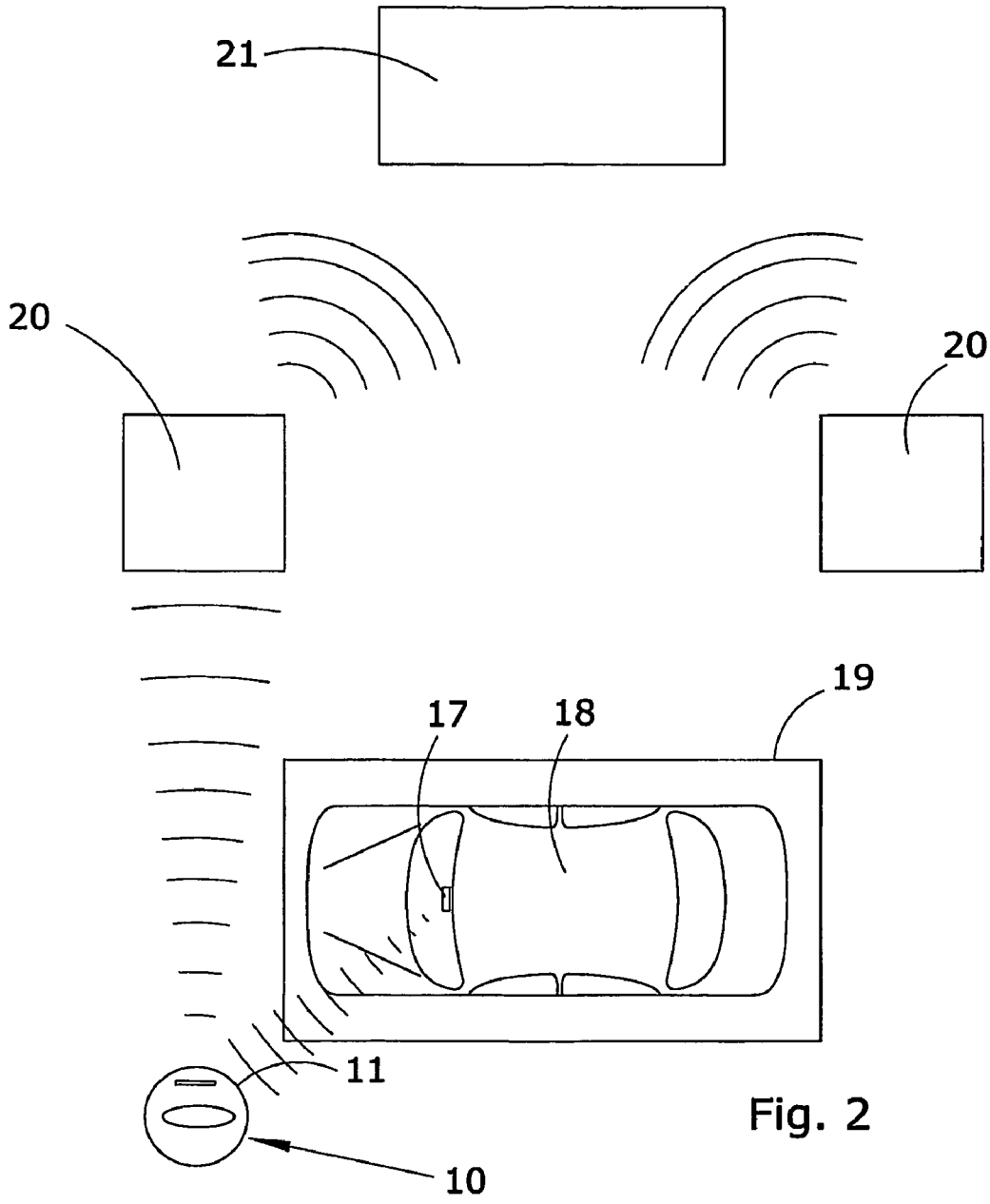
FIG. 2 is a simplified diagram of the devices making up the system according to the invention.

With reference to FIG. 2, it can be seen that the integrated automatic system for remote monitoring and management of vehicle access and parking in urban areas on a selective basis comprises:

a mobile recognition device 17, containing a user code, which can be positioned inside a vehicle 18;

a detection sensor 11 installed next to a respective parking space 19;

a network connecting the detection sensors 11 to a fixed data collection station 20;

a second network connecting several fixed stations 20 designed to collect the data from the respective parking space areas;

a control centre 21, connected to the second network, for decoding and reprocessing the data.

The presence sensors 11 allow both reception of the user code, transmitted by radio-frequency by the identification device 17 when the vehicle is parked, and the detection (not backed by frequency signals) of the presence of vehicles 17 or motorcycles unequipped with the aforesaid device and parked in the parking areas 19 controlled by the sensors.

In the first case, the signal sent to the fixed stations 20 for data transmission will be the user code.

In the second case, a signal is emitted warning the control centre 21 that a vehicle 17 without the identification device is parked (information which can trigger on-the-spot checks).

The need to detect the presence of any vehicle 18 parked in a specific parking area, even if it is not equipped with the recognition device, foresees the use of sensors 11 equipped with two separate electronic circuits: one dedicated to the reception-transmission of radio-frequency signals, the other designed to detect the presence of a vehicle in the specific space, for example a detector which is sensitive to the changes in magnetic induction within a determined space (a parameter which makes it possible to establish the presence or absence of a vehicle 18).

The functioning principle of the interconnected fixed stations 20 consists of the acquisition of data (user code or generic parking signal) from the detection sensors 11 and the transmission of the data to the central control unit 21.

The fixed stations 20 receive signals from the column 10 positioned at the start of a certain row of parking spaces or inside a car park.

These columns 10 are powered by connection to a normal electricity power line.

In order to carry out the required functions, the stations 20 and the columns 10 are equipped with specific hardware and firmware.

The control centre 21 acquires all the data from the from the fixed stations 20 located in the peripheral areas and reprocesses them by means of the IT system and is equipped with appropriate printing and display options, both on the spot and in remote units.

The IT system not only organises the data by means of specific databases and software for area management, but also carries out a series of complex processes in order to automatically inform the operators of any infringements committed by the users.

Knowing exactly where and by whom the infringement is committed will ensure the subsequent notification of the fine and will, if necessary, trigger the intervention of the traffic police.

The identification device 17 consists of a miniaturized transmitter which can be positioned inside a vehicle 18 and equipped with a memory containing the user identification code.

Alternatively, according to a preferred embodiment, the identification device 17 consists of the mobile telephone of the user, who by means of appropriate transmissions, for example SMS messages or a GPRS connection, communicates his/her identity to a receiving device positioned in the column.

The device 17 ensures minimal electromagnetic pollution, limited energy consumption and a high degree of autonomy.

Advantageously, detection sensors 11 present a minimum radius of action of around 5 metres, an amplifier noise temperature of less than 290° K, an amplifier gain between 40 and 50 dB and a transmission frequency between 20 and 500 kHz.

The columns 10 and the fixed data transmission stations 20 can have a maximum emission power of 1 mW, a transmission time of less than 2 min/h and a transmission band between 10 Hz and 50 KHz. They can also be equipped with a microprocessor functioning at a frequency between 75 and 100 MHz, with a RAM of up to 10 Mbyte and a fixed EEPROM of up to 500 Kbyte while their interface with the control centre 21 can be the bidirectional serial type as they are equipped with an integrated modem for data transmission.

The data collection centre 21 can receive the data by cable and by radio-frequency and can be equipped with means of intermittent transmission (polling), restricting irradiated power to a minimum.

The antenna gain is advantageously between 3 and 6 dB, while the preamplifier gain could fluctuate between 70 and 80 dB and the signal/noise ratio between 50 and 60 dB.

DESCRIPTION OF THE PROCEDURE

The procedure for the management of the integrated automatic system, for the remote monitoring and management of vehicle access and parking in urban areas on a selective basis, foresees:

- the detection of the presence of a vehicle 18 in a specific respective parking space 19;
- the recognition of the vehicle 18 as authorized or not authorized to use the space 19;
- the emission of a visual and/or acoustic signal confirming occupation of the space 19;
- the detection of the time in which the vehicle 18 is parked in the parking space 19;
- the transmission of the occupation of the parking space 19 and of the data relative to the recognised or not recognised vehicle 18 to a general area control device 20;
- the transmission of the data collected by several area control devices 20 to a central unit 21 designed to store the data relative to recognised vehicles 18 and to immediately report any unauthorised occupation by vehicles 18 without authorization;
- the calculation, by the central unit 21, of the fee in relation to the parking time;
- the transmission of the data regarding the fee to a bank authorized for payment with the consent of the user.

The invention is described above with reference to a particularly advantageous embodiment.

It is nevertheless clear that the invention is susceptible to numerous variations, within the framework of technical equivalents.

By way of example, one embodiment is foreseen which can be used in particular in the case of ground level car parks.

In this case it is not possible to arrange an area of rows of vehicles as in the cases described above, and the vehicles are not parked in an orderly fashion, and may even face different directions within the same slot; the slots are very close to each other.

In order to set up the system according to this invention the use of a modified sensor installed on the vehicle is foreseen, having a pair of LCD displays (one internal and one external), a pair of pushbuttons, for parking start and end respectively, an active RFID tag, a buzzer and a two-color LED. The column, on-the other hand, is equipped with a vehicle sensor of the type described above and a bidirectional controller of the RFID tag.

Let's look at a typical case, in which the user intends to park in a ground level car park. The vehicle sensor (VS) sends a request for identification and the tag on the column (AT) replies.

The user then presses the "parking start" pushbutton, and the AT sends the ID and the parking start information to the VS.

The VS sends an acceptance signal to the AT (green LED for 2 seconds and buzzer sound) and sends the data to the central system. At the end of the parking time the user presses the "parking end" pushbutton, the AT sends the information to the VS which replies in acceptance (green LED for 2 seconds and buzzer sound) and to the central system.

This and other variations are included within the framework described by the following claims.

The invention claimed is:

1. An integrated automatic system for remote monitoring and management of vehicle access and parking in urban areas on a selective basis comprising: a mobile recognition device, in which a user code is memorized, and which can be positioned inside a vehicle; a detection sensor installed close to a respective parking space; a network connecting the detection sensors to a fixed data collection station; and a control centre, connected to a second network, for decoding and reprocessing the data;

wherein the mobile recognition device comprises a pair of displays; a pair of parking start and end pushbuttons; an active RFID tag; a buzzer; and a two-color indicator.

2. A system according to claim 1, further comprising: the second network connecting a plurality of fixed stations designed to collect data from respective areas with parking spaces.

3. The system of claim 1, wherein the mobile recognition device consists of a mobile telephone or a miniaturized device, which can be positioned inside the vehicle, equipped with a memory containing the user identification code.

4. A system according to claim 3, wherein the code is transmitted automatically or manually by radio-frequency to the detection sensors.

5. The system of claim 1, wherein each detection sensor is located inside an external unit positioned close to a respective parking area.

6. A system according to claim 5, wherein each external unit comprises: luminous indicators which confirm the detection of an authorized or not authorized vehicle; an interface, designed to communicate with the user; and means for issuing receipts or printed messages of use to the authorized user.

7. A system according to claim 5, wherein each external unit presents a buzzer which is activated in the event of detection of a vehicle parked without authorization.

8. The system of claim 2, wherein the mobile recognition device consists of a mobile telephone or a miniaturized device, which can be positioned inside the vehicle, equipped with a memory containing the user identification code.

9. The system of claim 2, wherein each detection sensor is located inside an external unit positioned close to a respective parking area.

10. The system of claim 3, wherein each detection sensor is located inside an external unit positioned close to a respective parking area.

11. The system of claim 4, wherein each detection sensor is located inside an external unit positioned close to a respective parking area.

12. A system according to claim 6, wherein each external unit presents a buzzer which is activated in the event of detection of a vehicle parked without authorization.

13. A method for the management of an integrated automatic system for remote monitoring and management of vehicle access and parking in urban areas on a selective basis comprising:

detecting the presence of a vehicle in a specific respective parking space with a mobile recognition device, in which a user code is memorized, and which can be positioned inside a vehicle; a detection sensor installed close to a respective parking space; a network connecting the detection sensors to a fixed data collection station; and a control centre, connected to a second network, for decoding and reprocessing the data; wherein the mobile recognition device comprises a pair of displays; a pair of parking start and end pushbuttons; an active RFID tag; a buzzer; and a two-color indicator;

recognizing the vehicle as authorized or not authorized to use the space;

emitting a visual or acoustic signal confirming the occupation of the space;

detecting the parking time of the vehicle in the parking space;

transmitting the occupation of the parking space and of the data regarding the recognised or not recognised vehicle to one or more area controller devices;

transmitting the data collected by the one or more area controller devices to a central processing unit designed to store the data regarding recognized vehicles and to immediately report any unauthorized occupation by vehicles without authorization;

calculating, by the central unit, of the fee in relation to, the parking time; and transmitting the data relative to the fee to a bank authorized for payment with the consent of the user.

* * * * *